US008424639B1

(12) United States Patent
Davis

(10) Patent No.: US 8,424,639 B1
(45) Date of Patent: Apr. 23, 2013

(54) COLLAPSIBLE TREE STAND WITH DOLLY

(76) Inventor: Gregory J. Davis, Meridian, MS (US)

( * ) Notice: Subject to any disclaimer, the term of this patent is extended or adjusted under 35 U.S.C. 154(b) by 558 days.

(21) Appl. No.: 12/686,676

(22) Filed: Jan. 13, 2010

(51) Int. Cl.
*E06C 1/397* (2006.01)

(52) U.S. Cl.
USPC ..... 182/20; 182/115; 182/116; 182/178.3; 182/178.4; 182/178.5; 182/178.6

(58) Field of Classification Search ..... 182/20, 182/115, 116, 178.3, 178.4, 178.5, 178.6
See application file for complete search history.

(56) References Cited

U.S. PATENT DOCUMENTS

| | | | | |
|---|---|---|---|---|
| 3,282,375 | A * | 11/1966 | Ray | 182/16 |
| 4,009,762 | A * | 3/1977 | Bjerkgard | 182/20 |
| 4,428,456 | A * | 1/1984 | Rohde | 182/20 |
| 4,456,094 | A | 6/1984 | Brander | |
| 4,552,247 | A * | 11/1985 | Purdy | 182/116 |
| 4,579,198 | A * | 4/1986 | Lee | 182/115 |
| 4,582,165 | A | 4/1986 | Latini | |
| 5,064,020 | A * | 11/1991 | Eagleson | 182/20 |
| 5,282,520 | A * | 2/1994 | Walker | 182/116 |
| 5,295,556 | A | 3/1994 | Mullin | |
| 5,314,042 | A * | 5/1994 | Adams | 182/187 |
| 5,624,008 | A | 4/1997 | Beardslee, Jr. | |
| 5,791,436 | A * | 8/1998 | Talley, Sr. | 182/116 |
| 5,839,538 | A * | 11/1998 | Magyar | 182/20 |
| 6,053,278 | A * | 4/2000 | Myers | 182/20 |
| 6,186,271 | B1 | 2/2001 | Borries et al. | |
| 6,199,660 | B1 * | 3/2001 | Meeks | 182/116 |
| 6,308,968 | B1 | 10/2001 | Hollingsworth | |
| 6,505,707 | B1 * | 1/2003 | Berry | 182/20 |
| 6,516,918 | B2 * | 2/2003 | Hess | 182/20 |
| 6,516,919 | B1 * | 2/2003 | Sempel | 182/20 |
| 6,688,635 | B1 | 2/2004 | Watts | |
| 6,719,093 | B2 * | 4/2004 | Garbs | 182/116 |
| 6,811,180 | B1 * | 11/2004 | Molliere | 280/652 |
| 6,860,364 | B1 * | 3/2005 | Deemer | 182/20 |
| 6,880,835 | B2 | 4/2005 | Tornabene et al. | |
| 6,991,250 | B2 * | 1/2006 | Lindsey et al. | 280/651 |
| 7,021,423 | B1 * | 4/2006 | Pestrue et al. | 182/116 |
| 7,232,010 | B2 * | 6/2007 | Woller et al. | 182/116 |
| 7,306,074 | B2 | 12/2007 | Voorhies | |
| 2003/0146048 | A1 * | 8/2003 | Garbs | 182/116 |
| 2006/0207831 | A1 * | 9/2006 | Moore et al. | 182/20 |
| 2007/0235255 | A1 * | 10/2007 | Wallace et al. | 182/20 |
| 2009/0178884 | A1 * | 7/2009 | Maletestinic et al. | 182/20 |
| 2009/0229914 | A1 * | 9/2009 | Liles | 182/63.1 |

* cited by examiner

*Primary Examiner* — Katherine Mitchell
*Assistant Examiner* — Colleen M Chavchavadze
(74) *Attorney, Agent, or Firm* — Montgomery Patent and Design; Robert C. Montgomery

(57) ABSTRACT

A combination tree stand and hand truck are herein disclosed, comprising a seat mounted on the bottom of a conventional wheeled hand truck. The rear of the hand truck comprises a plurality of cross members and is attached via a pair of hinges to an additional section of a ladder like structure that is capable of being foldable extended to form a ladder. In use, the wheeled hand truck may be used to transport items to and from a hunting location. Once at a hunting location, the hand truck may be converted into a tree stand by deploying the folding ladder section and placing the deployed stand upside down against a tree or other structure therewith a securing means. The apparatus is particularly useful in game lands and other restricted hunting areas where an all-terrain vehicle or other motorized vehicle is not permitted.

17 Claims, 5 Drawing Sheets

COLLAPSIBLE TREE STAND WITH DOLLY

RELATED APPLICATIONS

The present invention was first described in a notarized Official Record of Invention on Sep. 26, 2008, that is on file at the offices of Montgomery Patent and Design, LLC, the entire disclosures of which are incorporated herein by reference.

FIELD OF THE INVENTION

The present invention relates generally to a tree stand for use while hunting, and in particular, to a collapsible, impermanent tree stand with an integral dolly for transporting the tree stand easily.

BACKGROUND OF THE INVENTION

Hunting is an increasingly popular and technological endeavor. Much of the success and enjoyment of hunting comes from the ability to approach hunting from a variety of different angles and different challenges. In particular tree stands are a popular way to approach various hunting situations, allowing a user the ability to spot game from an elevated and hidden position.

While tree stands provide added safety to a hunter in an elevated perch, they have many difficulties. The ease of access and installation is one such consideration. Stability is another concern. While some simple, permanent type tree stands are relatively simple to install and stable as well, transporting and uninstalling them is very difficult. In many areas, tree stands are not allowed to be left in place, and the user has great difficulty managing the removal and transport of the stand after use.

Various attempts have been made to provide a tree stand. Examples of these attempts can be seen by reference to several U.S. patents. U.S. Pat. No. 4,582,165, issued in the name of Latini, describes a portable tree stand. The Latini stand has backpack type straps for the transportation of the apparatus.

U.S. Pat. No. 7,306,074, issued in the name of Voorhies, describes a climbing tree stand. The Voorhies apparatus helps a user to scale a tree as well as providing a perch.

While these devices fulfill their respective, particular objectives, each of these references suffer from one or more of the aforementioned disadvantages. Many such apparatuses are cumbersome or uncomfortable to transport. Also, many such apparatuses do not provide the user with easy access to the upper reaches of a tree. Also, many such apparatuses do not provide easily installable, secure perches to the user. Furthermore, many such apparatuses do not provide any additional storage or transportation capabilities to assist the hunter in the storage and placement of other hunting accessories in addition to the tree stand. Accordingly, there exists a need for a transportable tree stand without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide a transportable tree stand which allows a single user to easily transport the device while also providing secure installation, easy perch access, item storage, and quick and simple single-person breakdown capabilities. Thus, the object of the present invention is to solve the aforementioned disadvantages and provide for this need.

To achieve the above objectives, it is an object of the present invention to combine a portable laddered tree stand with a combined wheeled platform. The apparatus comprises a ladder portion, a bottom portion able to be transported and anchored, a top portion comprising a seat assembly, and an intermediate portion comprising an adjustable tree brace.

Another object of the present invention is to comprise the ladder portion of a plurality of rungs, a pair of upper side rails, and a pair of lower side rails in the form of a tubular inclined rigid ladder. Ratcheting tie-downs are preferably utilized to securely position the apparatus to a tree.

Yet still another object of the present invention is to comprise the bottom portion of a pair of first wheels and a ground anchor. The ground anchor comprises a pair of parallel metal rods with pointed ends which easily puncture a ground surface.

Yet still another object of the present invention is to comprise an intermediate portion of the apparatus of an adjustable tree brace to stabilize the apparatus on a tree. The brace comprises a plurality of adjustment indentations and an extension rod with an adjustment fastener. The brace mates with the extension rod in a slidably engaging manner and is secured via the adjustment fastener.

Yet still another object of the present invention is to comprise the adjustment fastener of a bolt which is screwed into a desired depressed portion of the tree brace by means of a washer which is welded to the extension rod. The extension rod is permanently attached to an intermediate rung of the ladder portion.

Yet still another object of the present invention is to comprise the top portion of the apparatus of a seat frame, a back portion, a seat portion, a hanger, and a foot portion. This provides a user with a sitting position and a hanging storage for equipment such as a coat, gun, bag, or the like. The seat frame is integrated into a horizontal top portion of the apparatus.

Yet still another object of the present invention is for the first wheels to provide movement while in the collapsed position in conjunction with the tree brace. A perpendicular contoured extrusion of the brace allows the user to grip and pull the brace like a handle and easily transport the apparatus due to the first wheels. The wheels are mounted to a lower side rail via a wheel bracket, and they use a conventional axle system.

Yet still another object of the present invention is to comprise a pair of second wheels located behind the seat frame to guide the invention while it is being placed against a tree. The wheel assembly also includes a pair of tree anchors. The tree anchors comprise a means of stabilizing the apparatus against a tree in the deployed position. A pair of compression springs allows the wheels to be depressed toward the seat portion, thereby extracting the tree anchors and allowing them secure to a tree.

Yet still another object of the present invention is to provide a pair of hinges at a pivot joint located between the upper and lower side rail portions. The hinge provides a conversion means allowing the apparatus to fold into the collapsed, movable state. The hinge further comprises a sliding bracket and a fastener to allow a user to adjust the length of the hinge as well as locking the hinge in place when used in the straight, deployed position.

Yet still another object of the present invention is to provide a method of utilizing the device that provides a unique means of allowing a user to utilize an impermanent tree stand in a manner which is quick, efficient, and physically tenable for a single user.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
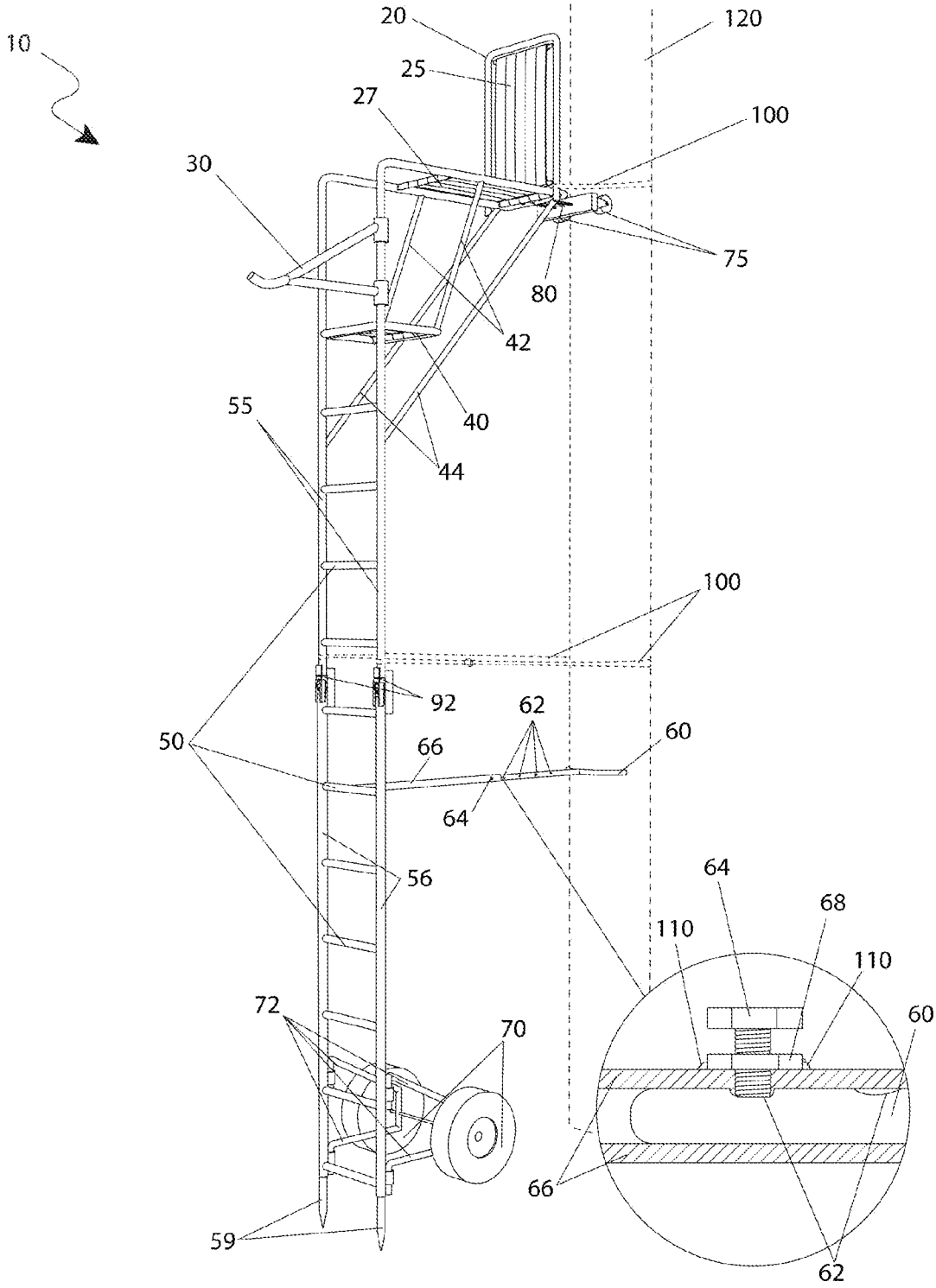
FIG. 1 is a perspective view of a collapsible tree stand with dolly 10 depicting an erected state and a cross-section view of an adjustable brace 60, according to a preferred embodiment of the present invention.

10 collapsible tree stand with dolly
20 seat frame
25 back portion
27 seat portion
30 hanger
40 foot portion
42 first bracket
44 second bracket
50 rung
55 upper side rail
56 lower side rail
59 ground anchor
60 tree brace
62 adjustment indentation
64 adjustment fastener
66 extension rod
68 washer
70 first wheel
72 wheel bracket
75 second wheel
80 compression spring
82 tree anchor
84 plate
85 plate fastener
86 second wheel fastening means
88 fork
90 hinge brace
92 hinge
94 bracket fastening means
96 sliding bracket
100 ratcheting tie-down
110 weld
120 tree

DETAILED DESCRIPTION OF THE PREFERRED EMBODIMENT

The best mode for carrying out the invention is presented in terms of its preferred embodiment, herein depicted within FIGS. 1 through 4*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a collapsible tree stand with dolly (herein described as the "apparatus") 10, which provides a means for a portable laddered tree stand therewith a combined wheeled platform. The apparatus 10 comprises a seat frame 20, a hanger 30, a foot portion 40, a plurality of rungs 50, a pair of upper side rails 55, a pair of lower side rails 56, a ground anchor 59, a tree brace 60, a pair of first wheels 70, a pair of second wheels 75, and a tree anchor 82. The apparatus 10 is ideal for a hunter whom hunts in areas which prohibit the use of permanently erected tree stands. Said apparatus 10 also allows for the removal and transportation of game animals therewith the wheeled platform.

Referring now to FIG. 1, a perspective view of the apparatus 10 depicting an erected state and a cross-section view of an adjustable brace 60, according to the preferred embodiment of the present invention, is disclosed. The apparatus 10 takes the form of a tubular inclined rigid ladder, thereby enabling a user to climb therein and situate them in an elevated position. The ladder portion is similar to conventional ladders and/or ladder tree stands and comprises a plurality of rungs 50, a pair of upper side rails 55, and a pair of lower side rails 56. The apparatus 10 is envisioned to be fabricated from a metal such as, but not limited to: steel, aluminum, or the like. Ratcheting tie-downs are also preferably utilized thereto securely position said apparatus 10 to a tree 120.

Figure 2:
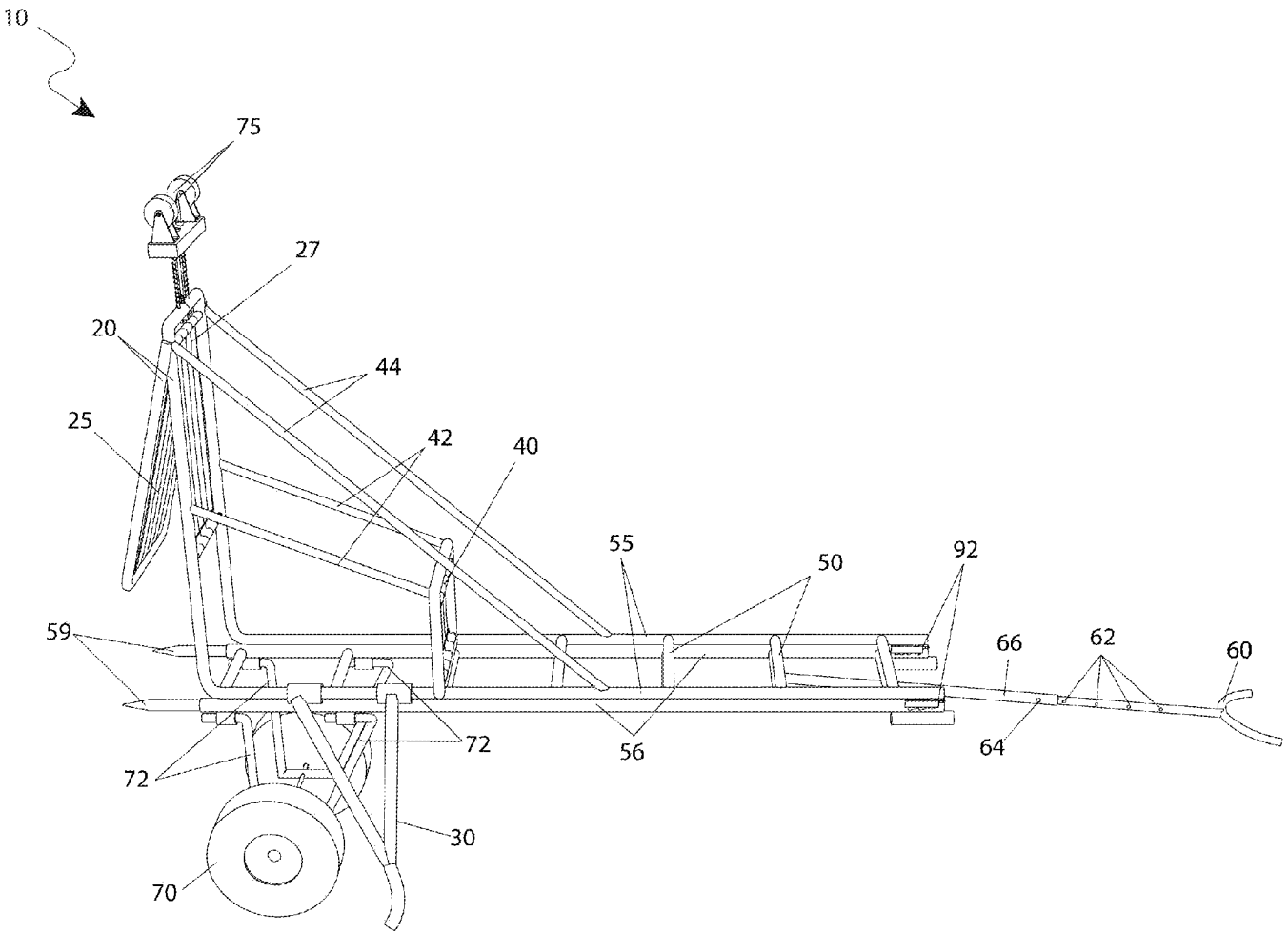
FIG. 2 is a perspective view of the collapsible tree stand with dolly 10 depicting a collapsed position, according to a preferred embodiment of the present invention.

A bottom portion of the apparatus 10 comprises a pair of first wheels 70 and a ground anchor 59 (see FIG. 2). An intermediate portion comprises an adjustable tree brace 60, thereby stabilizing the apparatus 10 thereon a tree 120 or other vertical surface. The tree brace 60 comprises a plurality of equidistantly-spaced adjustment indentations 62 and works in conjunction with an extension rod 66 which comprises an adjustment fastener 64. The tree brace 60 mates with the extension rod 66 by a slidably engaging technique and is secured to a desired length with the adjustment fastener 64 mating with a desired adjustment indentation 62. An aperture (not shown) is located on an end portion of the extension rod 66, thereby permitting an insertion of the adjustment fastener 64. Said adjustment fastener 64 is a bolt that which is inserted and screwed onto the desired depressed portions of the tree brace 60 by means of an attached washer 68. Said washer 68 is attached to the extension rod 66 with welding 110 techniques parallel to the aperture. The extension rod 66 is attached to an intermediately located rung 50 with common fastening means such as, but not limited to: welding 110, hinges, or the like. The adjustment indentations 62 are located on an end portion of the tree brace 60 and comprise a slight depression to mate to the corresponding adjustment fastener 64. The tree brace 60 comprises a perpendicular extrusion at one (1) end, thereby enabling resting against the tree 120 for support. The tree brace 60 also provides a handle to enable the user to pull the apparatus 10 when in a collapsed position (see FIG. 2). The tree brace 60 and extension rod 66 are fabricated from similar materials to the ladder portion aforementioned. The intermediate portion also comprises a hinge 92, thereby allowing the apparatus 10 to fold and collapse for transporting (see FIGS. 4*a* and 4*b*).

A top portion of the apparatus 10 comprises a seat frame 20, a back portion 25, a seat portion 27, a hanger 30, and a foot portion 40, thereby providing the user with a sitting position and hanging storage for associated equipment while in use. The seat frame 20 enables the user to sit therein, which is integrated into a horizontal top portion of the apparatus 10. The seat frame 20 comprises a back portion 25 and a seat portion 27 comprising interweaved fabric, thereby creating a backing platform and sitting platform for the user. The seat frame 20 is supported via a pair of downwardly angled second brackets 44 each attached to a lower section of the seat portion 27 and to the upper side rails 55. The second bracket is fabricated from a metal material such as, but not limited to: steel, aluminum, or the like.

The top portion of the apparatus 10 also comprises a foot portion further comprising a grated platform located below the seat portion 27. A rear section of said foot portion 40 is attached to a downwardly positioned "U"-shaped first bracket 42 which is attached to a lower portion of the seat frame 20. A front section of said foot portion 40 is attached to the upper side rails 55. Said attachments are created with conventional fastening techniques such as, but not limited to: welding 110, hinges, or the like. The foot portion 40 and first bracket 42, are also fabricated from a metal material such as, but not limited to: steel, aluminum, or the like.

The top portion of the apparatus 10 further comprises a triangular hanger 30, thereby providing a hanging storage for the user to associated equipment such as, but not limited to: a coat, a gun, an equipment bag, or the like. The hanger 30 is attached to the upper side rail 55 with fastening means such as, but not limited to: clamps, welding 110, or the like. Said hanger 30 is also fabricated from similar metal materials as above-mentioned.

Referring now to FIG. 2, a perspective view of the apparatus 10 depicting a collapsed position, according to the preferred embodiment of the present invention, is disclosed. Shown collapsed position enables the user to transport hunted animals or other equipment, thereby placing the animal and/or equipment above the upper side rails 55 and carting the apparatus 10 with a pair of first wheels 70 and tree brace 60.

The apparatus 10 also comprises a pair of first wheels 70, thereby providing movement to said apparatus 10 while in the collapsed position. The first wheels 70 work in conjunction with the tree brace 60, thereby allowing the user to grip and pull the perpendicular contoured extrusion thereon the tree brace 60, as like a handle, with ease due to the first wheels 70. Said first wheels 70 are mounted to each lower side rail 56 and utilize a conventional axle system. Each first wheel 70 is supported therewith a "U"-shaped wheel bracket 72 which is further welded 110 thereto a respective lower side rail portion 56. Said first wheels 70 are preferably fabricated with a plastic rim and solid rubber tire, thereby enabling a user to transport the apparatus 10 in a variety of terrain. Said first wheels 70 are also preferably sixteen (16) inches in diameter, yet other sized wheels may be utilized without limiting the function of the apparatus 10.

The apparatus 10 comprises a pair of parallel ground anchors 59, thereby providing stabilizing support while said apparatus 10 is in use. The ground anchors 59 are comprised of metal rods pointed ends to easily puncture a ground surface. Said ground anchors 59 extend from each lower side rail 56 and are fabricated from similar aforementioned materials.

The apparatus 10 further comprises a pair of second wheels 75, thereby a guiding the apparatus 10 while positioned against a tree 120 in the erected position. Said second wheels 75 are located at a rear portion of the seat frame 20 and are an appropriately spaced distance to engage the tree 120, thereby allowing for a stabilized vertical upward motion to said tree 120. Said second wheels 75 work in conjunction with a pair of compression springs 80 and a pair of tree anchors 82 (see FIG. 3).

Figure 3:
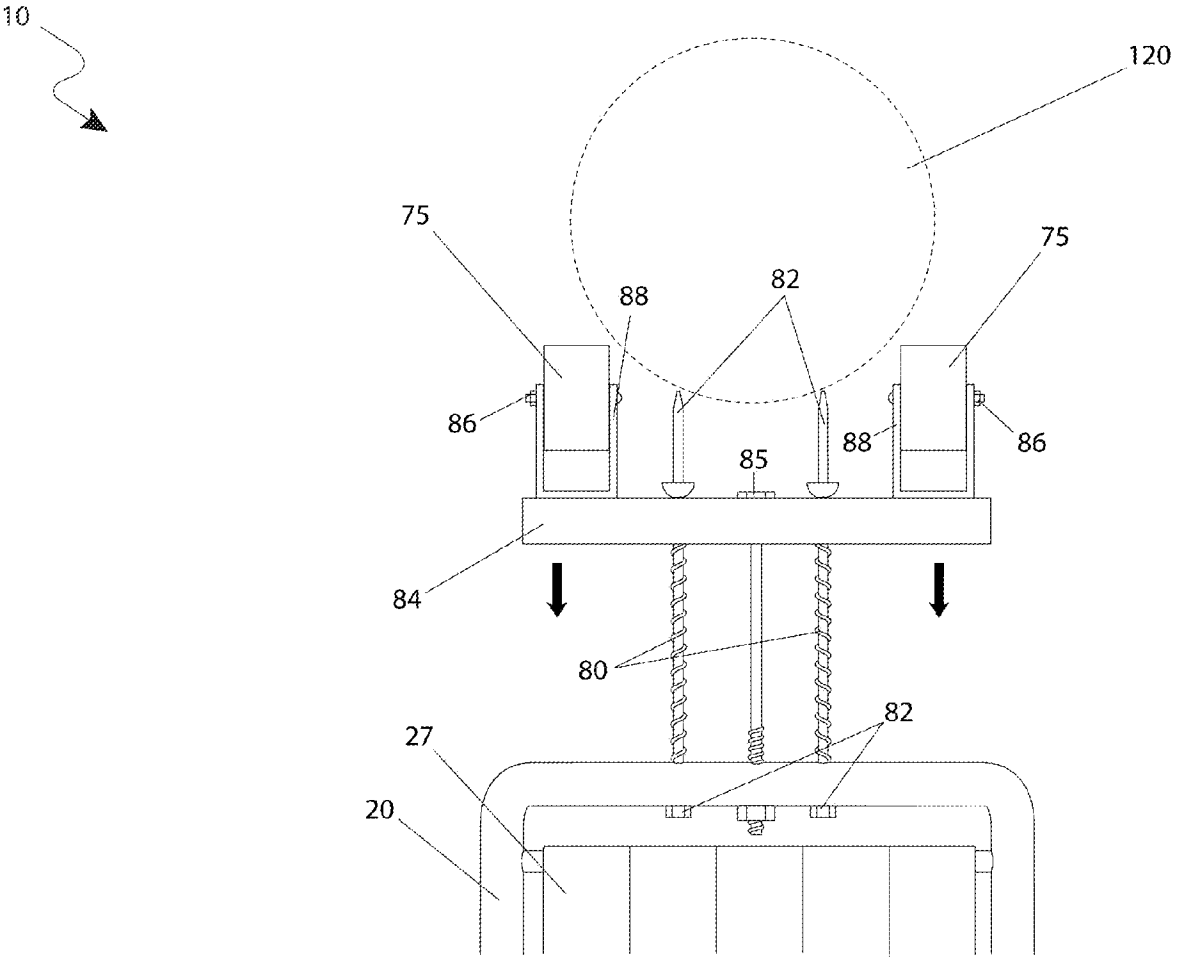
FIG. 3 is a close-up view the collapsible tree stand with dolly 10 depicting a pair of tree anchors 82 and associated components, according to a preferred embodiment of the present invention.

Referring now to FIG. 3, a close-up view the apparatus 10 depicting a pair of tree anchors 82 and associated components, according to the preferred embodiment of the present invention, is disclosed. The apparatus 10 comprises a pair of second wheels 75, a pair of compression springs 80, and a pair of tree anchors 82, thereby providing a stabilizing aspect while in the deployed position. These components allow the apparatus 10 to glide upward against the tree 120 and secure into said tree 120. The second pair of wheels 75 is similar to common caster wheels which each are fastened to a fork 88 by means of a second wheel fastening means 86. Each fork 88 is attach to a flat plate 84 and each second wheel fastening means 86 is preferably a bolt and nut combination, yet other fastening means may be incorporated without limiting the function of the apparatus 10. The plate 84 is fastened to the seat frame 20 by means of a plate fastener 85 which comprises a bolt and nut inserted through and fastened to the plate 84 and seat frame 20.

The plate 88 is attached to the pair of compression springs 80 and the pair of tree anchors 82. Said compression springs 80 allow the plate 88 to be depressed toward the seat portion 27, thereby allowing the tree anchors 82 to extract and secure to the tree 120. Each of said tree anchors 82 are affixed to the seat frame 20 and routed through the plate 84 and each of the pair of compression springs 80 encompass the span of each tree anchor 82 between the seat frame 20 and plate 84.

Figure 4A:
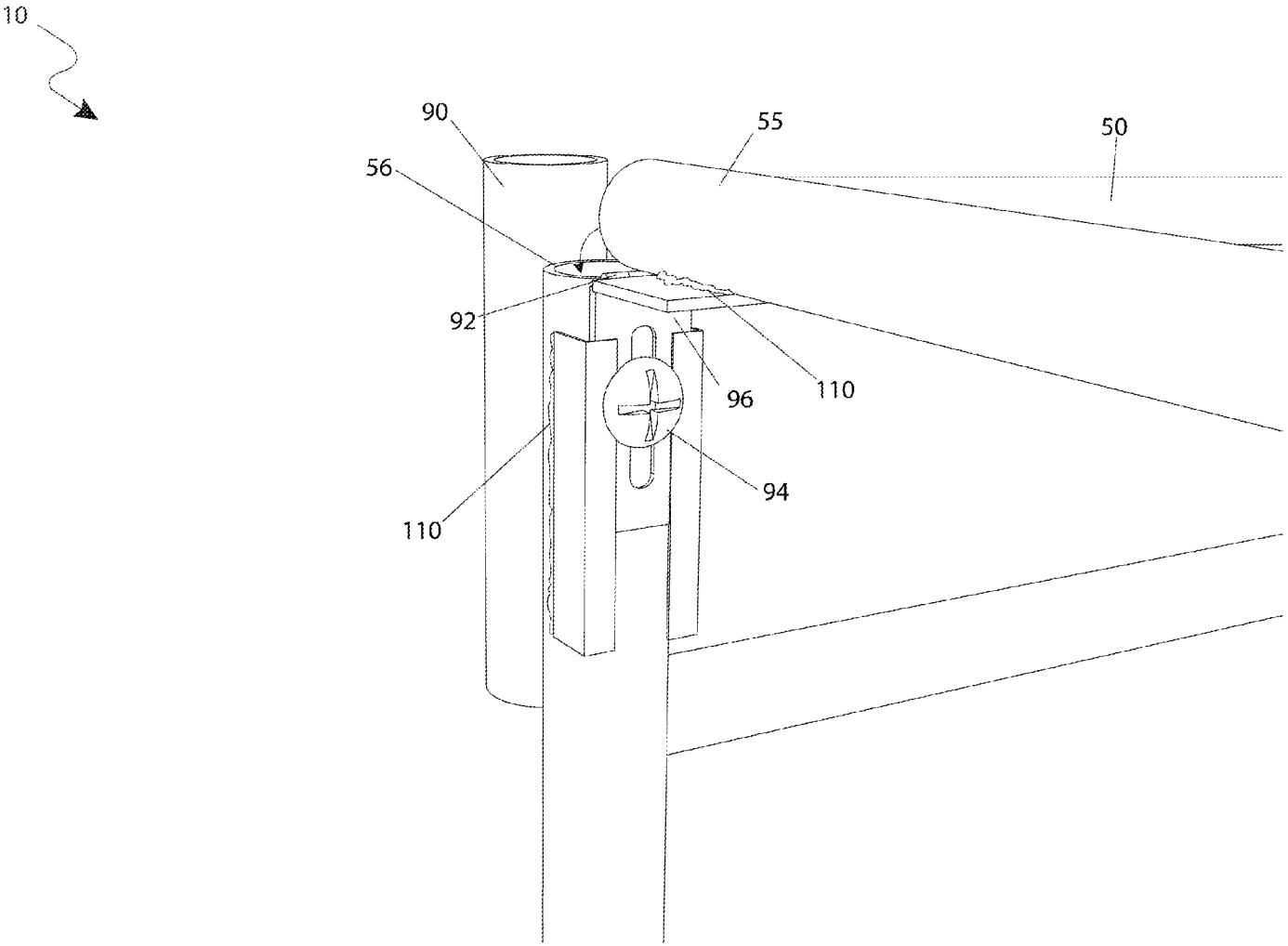
FIG. 4*a* is a close-up view of a hinge 92 depicting a collapsed state, according to a preferred embodiment of the present invention; and, FIG. 4*b* is the close-up view of the hinge 92 depicting an erected state, according to a preferred embodiment of the present invention.
Figure 4B:
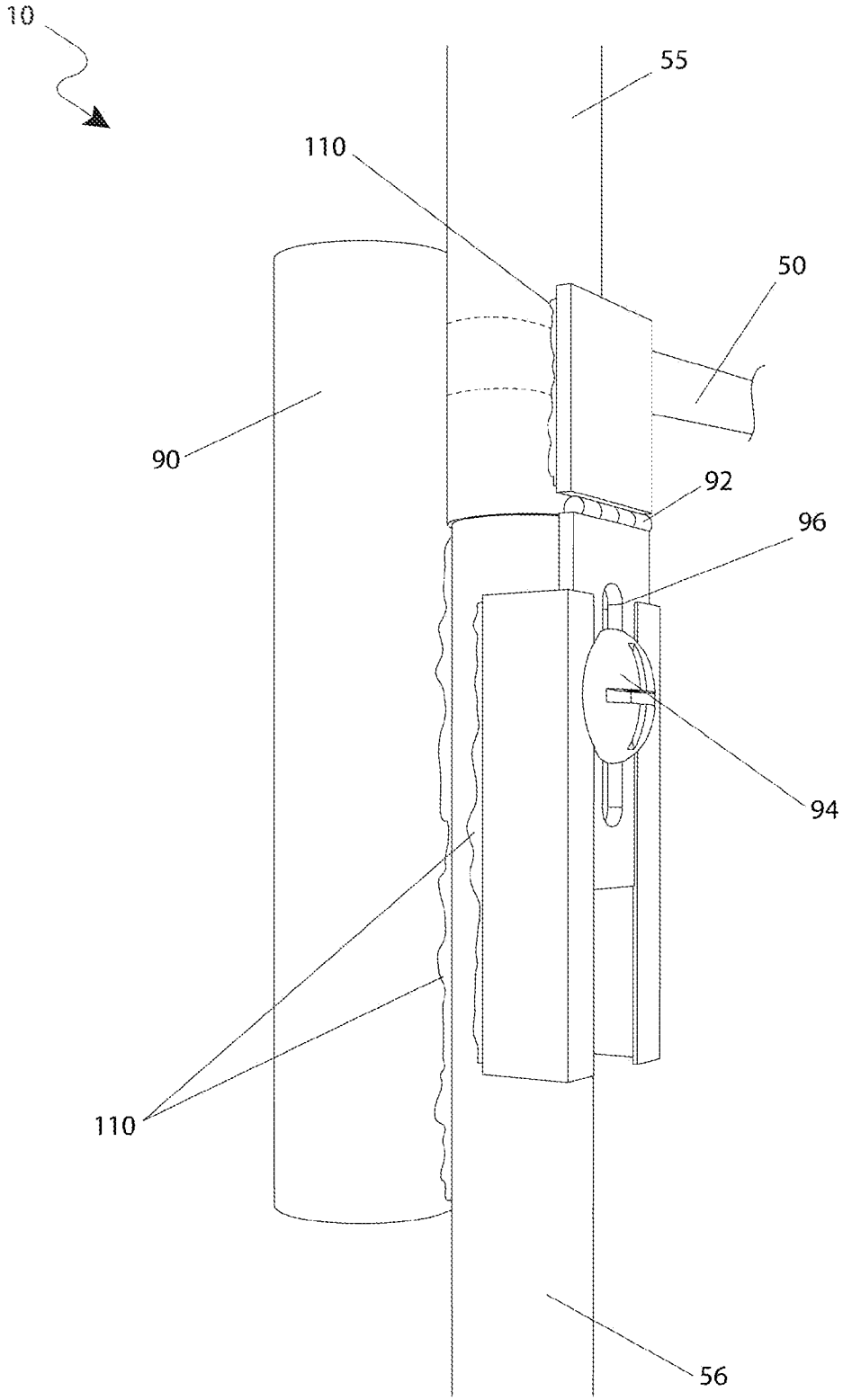

Referring now to FIG. 4*a*, a close-up view of the hinge 92 depicting a collapsed state and FIG. 4*b*, a close-up view of a hinge 92 depicting an erected state, according to the preferred embodiment of the present invention, are disclosed. The intermediate portions of the apparatus 10 comprise a pair of hinges 92, thereby providing a joint to pivot said apparatus 10 to a collapsed state or erected state. The hinge 92 is welded 110 onto the lower portion of the upper side rails 55 and an upper portion of the lower side rails 56 although other fastening techniques may be incorporated without limiting the functions of the apparatus 10. The length of the hinge 92 may be adjusted by means of a sliding bracket 96 and locked into position by means of a bracket fastening means 94.

The apparatus 10 also comprises a hinge brace 90, thereby limiting the rotation of the hinge 92 and supporting said hinge 92 while in the erected position. The hinge brace 90 is a tubular metal section welded 110 onto a rear portion of the lower side rail 56. As the hinge 92 is rotated to erect the apparatus 10 the upper side rail 55 engages the lower side rail 56 to form one (1) rigid member, thereby allowing the hinge brace 90 to align parallel to each side rails 55, 56.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 through 4B.

The method of installing and utilizing the apparatus 10 may be achieved by performing the following steps: acquiring said apparatus 10; collapsing said apparatus 10 by means of the hinge 92; utilizing the tree brace 60 and first wheels 70 in order to transport said apparatus 10 to a desired location; erecting said apparatus 10 by engaging the upper rails 55 with the lower rails 56; locking the hinge 92 with the bracket fastening means 94; utilizing the second pair of wheels 75 to guide the apparatus 10 upward against the tree 120; engaging the ground with the ground anchors 59; adjusting the tree brace 60 and extension rod 66 with the adjustment fastener 64 and adjustment indentations 62 to a desired position to engage the tree 120; encompassing the tree 120 with a ratcheting tie-down 100 and attaching to an intermediate position on the apparatus 10; utilizing the rungs 50, upper side rails 55, and lower side rails 56 to climb the apparatus 10 to the elevated position; gripping the plate 84, compressing the compression springs 80, and puncturing the tree 120 with the tree anchors 82; encompassing the tree 120 therewith a ratcheting tie-down 100 and attaching to an upper position on the apparatus 10; sitting on the seat portion 27 and resting against the back portion 25; positioning the user's feet on the foot portion 40; hanging equipment on the hanger 30; partaking in a normal hunting activity for a desired period of time; depressing the plate 84 to retract the tree anchors 82; removing ratcheting tie-down 100 from the upper portion of the apparatus 10 and tree 120; descending from the apparatus 10; removing ratcheting tie-downs 100 from the intermediate portion of the apparatus 10 and tree 120; collapsing said apparatus 10 by pivoting the hinge 92; utilizing the tree brace 60 to transport said apparatus 10 to a desired location; utilizing the apparatus 10 when necessary; and, enjoying the features and benefits of the portable tree stand.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A tree stand comprising:

a frame, comprising:

a horizontal top portion;

a ladder portion, comprising a pair of upper side rails depending downward from said top portion, a pair of lower side rails hingedly affixed to said pair of upper side rails and depending downwardly, and a plurality of rungs each supported on opposing ends by said pair of upper side rails and said pair of lower side rails;

a seat located at said top portion of said ladder portion;

a wheel assembly affixed to a bottom portion of said ladder portion; and, an anchoring means affixed to said bottom portion of said ladder portion;

wherein said seat is adapted to accommodate a user;

an adjustable tree brace assembly pivotally attachable to an intermediate location of said frame;

an upper tree brace assembly mounted to a rear portion of said seat, further comprising:

a plate having a front side affixed to said seat with a plate fastener;

a pair of brace assembly wheels, each wheel attached to a rear side of said plate with a fork and defining a distance between;

a pair of tree anchors, each routed through said plate and affixed to said seat with a fastener at a proximal end and having a pointed distal end; and, a pair of compression springs, each encompassing a tree anchor and spanning a space between said seat and said plate; and, a conversion means for converting said frame between a tree stand configuration and a dolly configuration;

wherein said anchoring means provides a stabilizing support for said tree stand when in said tree stand configuration;

wherein said adjustable tree brace assembly and said upper tree brace assembly secures said tree stand to a tree when in said tree stand configuration;

wherein said tree stand configuration enables said user to ascend and reside within said tree;

and, wherein said brace assembly wheels stably guides said tree stand against said tree when in said tree stand configuration;

wherein said pair of compression springs enable said plate to travel inwardly and outwardly from said seat along said plate fastener, thereby extracting and retracting said pair of tree anchors; and, wherein said pair of tree anchors are capable of engaging said tree when in said tree stand configuration.

2. The tree stand of claim 1, wherein said seat further comprises:

a foldable seat frame integrated into said top portion of said frame, further comprising a back portion and a seat portion thereby creating a backing platform and a sitting platform for said user;

a pair of seat frame brackets each attached to a bottom surface of said seat frame on a first end and to an intermediate location of each of said pair of upper side rails; and, a foot portion located subjacent of said seat frame and attached to a bottom surface of said seat frame with a foot bracket and to an upper portion of said pair of upper side rails;

wherein said pair of seat frame brackets supports said seat frame; and, wherein said foot portion is adapted to support feet of said user.

3. The tree stand of claim 2, wherein said back portion and said seat portion each comprise interwoven fabric.

4. The tree stand of claim 2, wherein said foot portion further comprises a grated platform.

5. The tree stand of claim 1, wherein said wheel assembly further comprises:

a pair of wheel assembly wheels each mounted on opposite ends of an axle; and, a "U"-shaped wheel bracket supporting each of said pair of first wheels to a lower portion of each of said lower side rails;

wherein said pair of wheel assembly wheels provides transportation when in said dolly configuration; and, wherein said pair of wheel assembly wheels comprises materials enabling transportation over uneven and rough terrain.

6. The tree stand of claim 1, wherein said anchoring means further comprises a pair of ground anchors each having a pointed end and mounted parallel to each other at a lower portion of each of said pair of lower side rails and extend outwardly therefrom.

7. The tree stand of claim 1, further comprising a hanger attached to an upper side rail adjacent to said seat to provide storage for desired items.

8. The tree stand of claim 1, wherein said adjustable tree brace assembly further comprises:

an extension rod having a proximal end pivotally attached to an intermediate rung at said intermediate location of said frame;

a tree brace, having a proximal end slidably engaged with said extension rod and a distal end having a handle; and, a brace adjustment means for adjustably securing said tree brace to said extension rod;

wherein said brace adjustment means enables a length adjustment of said tree brace with respect to said extension rod;

wherein said handle engages a diameter of said tree when said tree stand is in said tree stand configuration.

9. The tree stand of claim 8, wherein said brace adjustment means further comprises:

a plurality of equidistantly-spaced adjustment indentations located along said body of said tree brace; and, an adjustment fastener and a washer located at a distal end of said extension rod for correspondingly mating an individual adjustment indentation.

10. The tree stand of claim 1, wherein said conversion means further comprises:

a pair of hinges connecting said pair of lower side rails to said pair of upper side rails;

a sliding bracket secured with a fastener to each of said pair of hinges; and, a hinge brace comprising a tubular member affixed to an upper portion of each of said pair of lower side rails;

wherein said sliding bracket adjusts a length for each of said pair of hinges;

wherein said hinge brace limits rotation of each of said pair of hinges; and, wherein said hinge brace supports each of said pair of hinges when in said tree stand configuration.

11. A tree stand comprising:

a frame, further comprising:

a ladder portion, comprising a pair of upper side rails, a pair of lower side rails hingedly affixed to said pair of upper side rails and depending downwardly, and a plurality of rungs each supported on opposing ends by said pair of upper side rails and said pair of lower side rails;

a foldable seat frame affixed to a top portion of said ladder portion, further comprising a back portion and a seat portion thereby creating a backing platform and a sitting platform;

a pair of seat frame brackets each attached to a bottom surface of said seat frame on a first end and thereto to an intermediate location of each of said pair of upper side rails;

a foot portion located subjacent of said seat frame and attached to a bottom surface of said seat frame with a foot bracket and to an upper portion of said pair of upper side rails;

a pair of wheel assembly wheels each mounted on opposite ends of an axle;

a "U"-shaped wheel bracket supporting each of said pair of wheel assembly wheels to a lower portion of each of said lower side rails; and, an anchoring means affixed to said lower portion of said ladder portion;

an adjustable tree brace assembly pivotally attachable to an intermediate location of said frame, further comprising:

an extension rod having a proximal end pivotally attached to an intermediate rung at said intermediate location of said frame;

a tree brace, having a proximal end slidably engaged with said extension rod and a distal end having a handle; and, a brace adjustment means adjustably securing said tree brace to said extension rod, thereby enabling a length adjustment of said tree brace with respect to said extension rod;

an upper tree brace assembly mounted to a rear portion of said foldable seat frame, further comprising:

a plate having a front side affixed to a rear side of said foldable seat frame with a plate fastener;

a pair of brace assembly wheels, each wheel attached to a rear side of said plate with a fork and defining a distance between;

a pair of tree anchors, each routed through said plate and affixed to said rear side of said foldable seat frame with a fastener at a proximal end and having a pointed distal end; and, a pair of compression springs, each encompassing a tree anchor and spanning a space between said seat frame and said plate;

a hinge assembly to convert said frame between a tree stand configuration and a dolly configuration, further comprising:

a pair of hinges connecting said pair of lower side rails to said pair of upper side rails;

a sliding bracket secured with a fastener to each of said pair of hinges; and, a hinge brace comprising a tubular member affixed to an upper portion of each of said pair of lower side rails;

wherein said adjustable tree brace assembly and said upper tree brace assembly each secures said tree stand to a tree when in said tree stand configuration;

wherein said tree stand configuration enables said user to ascend and reside within said tree; and, wherein said anchoring means provides a stabilizing support for said tree stand when in said tree stand configuration.

12. The tree stand of claim 11, wherein said back portion and said seat portion each comprise interwoven fabric.

13. The tree stand of claim 11, wherein said foot portion further comprises a grated platform.

14. The tree stand of claim 11, wherein said anchoring means further comprises a pair of ground anchors each having a pointed end and mounted parallel to each other at a lower portion of each of said pair of lower side rails and extend outwardly therefrom.

15. The tree stand of claim 11, further comprising a hanger attached to an upper side rail adjacent to said seat frame to provide storage for desired items.

16. The tree stand of claim 11, wherein said brace adjustment means further comprises: a plurality of equidistantly-spaced adjustment indentations located along said body of said tree brace; and, an adjustment fastener and a washer located at a distal end of said extension rod for correspondingly mating an individual adjustment indentation.

17. A method of selectively converting a tree stand between a dolly configuration for transporting said tree stand to and from desired destinations and a tree stand configuration for enabling a user to ascend and reside said tree stand comprises the following steps:

providing said tree stand, further comprising:

a frame, comprising:

a ladder portion, comprising a pair of upper side rails, a pair of lower side rails hingedly affixed to said pair of upper side rails and depending downwardly, and a plurality of rungs each supported on opposing ends by said pair of upper side rails and said pair of lower side rails;

a foldable seat frame affixed to a top portion of said ladder portion, further comprising a back portion and a seat portion thereby creating a backing platform and a sitting platform;

a pair of seat frame brackets each attached to a bottom surface of said seat frame on a first end and to an intermediate location of each of said pair of upper side rails;

a foot portion located subjacent of said seat frame and attached to a bottom surface of said seat frame with a foot bracket and to an upper portion of said pair of upper side rails;

a hanger attached to an upper side rail adjacent to said seat frame to provide storage for desired items;

a pair of wheel assembly wheels each mounted on opposite ends of an axle;

a "U"-shaped wheel bracket supporting each of said pair of wheel assembly wheels to a lower portion of each of said lower side rails; and, a pair of ground anchors each having a pointed end and mounted parallel to each other at a lower portion of each of said pair of lower side rails and extend outwardly therefrom;

an adjustable tree brace assembly pivotally attachable to an intermediate location of said frame, further comprising:

an extension rod having a proximal end pivotally attached to an intermediate rung at said intermediate location of said frame;

a tree brace, having a proximal end slidably engaged with said extension rod and a distal end having a handle; and, a plurality of equidistantly-spaced adjustment indentations located along said body of said tree brace and an adjustment fastener and a washer located at a distal end of said extension rod for correspondingly mating with an individual adjustment indentation, thereby enabling a length adjustment of said tree brace with respect to said extension rod;

an upper tree brace assembly mounted to a rear portion of said foldable seat frame, further comprising:

a plate having a front side affixed to a rear side of said foldable seat frame with a plate fastener;

a pair of brace assembly wheels, each wheel attached to a rear side of said plate with a fork and defining a distance between;

a pair of tree anchors, each routed through said plate and affixed to said rear side of said foldable seat frame with a fastener at a proximal end and having a pointed distal end; and, a pair of compression springs, each encompassing a tree anchor and spanning a space between said seat frame and said plate; and, a hinge assembly to convert said frame between a tree stand configuration and a dolly configuration, further comprising:

a pair of hinges connecting said pair of lower side rails to said pair of upper side rails;

a sliding bracket secured with a fastener to each of said pair of hinges; and, a hinge brace comprising a tubular member affixed to an upper portion of each of said pair of lower side rails;

transporting said tree stand when in said dolly configuration to a tree at a desired destination;

converting said tree stand from said dolly configuration to said tree stand configuration;

securing said tree stand to said tree;

anchoring said tree stand to a ground portion adjacent to said tree;

ascending said tree stand; and, residing in said foldable seat frame.

* * * * *